US005363999A

United States Patent [19]

Braun et al.

[11] Patent Number: 5,363,999

[45] Date of Patent: Nov. 15, 1994

[54] FASTENER FEEDER HAVING VIBRATORY BRUSH

[75] Inventors: Phillip M. Braun, Exerter; David J. Simonelli, Coventry, both of R.I.

[73] Assignee: Stanley-Bostitch, Inc., East Greenwich, R.I.

[21] Appl. No.: 112,149

[22] Filed: Aug. 26, 1993

[51] Int. Cl.[5] ..... B25C 1/04

[52] U.S. Cl. ..... 227/119; 227/120; 227/135

[58] Field of Search ..... 227/120, 130, 136, 114, 227/119, 112, 109, 116, 135

[56] References Cited

U.S. PATENT DOCUMENTS

| | | | |
|---|---|---|---|
| 3,797,723 | 3/1974 | Perkins et al. | 227/109 |
| 4,068,029 | 1/1978 | Armstrong . | |
| 4,503,993 | 3/1985 | Ginnow et al. | 227/117 |
| 4,706,865 | 11/1987 | Hammerle et al. | 227/116 |
| 5,004,141 | 4/1991 | Young et al. | 227/130 |
| 5,098,003 | 3/1992 | Young et al. | 227/117 |

*Primary Examiner*—Scott A. Smith

*Attorney, Agent, or Firm*—Cushman, Darby & Cushman

[57] ABSTRACT

A fastener feeding assembly for a fastener driving apparatus including a pair of spaced support members disposed in an opposed relation to one another along a feed path for a fastener package, the feed path having a proximal end leading laterally into a drive track of the apparatus. The feeding assembly includes a multiplicity of resilient bristles supported by one of the support members and extending transversely and toward the proximal end within the feed path. One of the support members supports the fastener package so that the package is engaged by free ends of the bristles by a force sufficient to maintain the package on the feed track against movement in a direction away from the proximal end. The other of the support members vibrates towards and away from the first support member in response to a vibratory pulse generated by the apparatus causing the fasteners of the fastener package to repeatedly flex the bristles in the feeding direction thereby feeding the fasteners toward the drive track to be driven.

23 Claims, 4 Drawing Sheets

10
12
14
16
17
18
19
20
24
26
28
30
32
34
35
V

FASTENER FEEDER HAVING VIBRATORY BRUSH

BACKGROUND OF THE INVENTION

This invention relates to a feeding mechanism for fastener driving devices and more particularly to fastening devices used in continuous production lines having a feeding mechanism for feeding successive fasteners into the drive track of the device.

Conventional staple feeding mechanisms must perform the task of feeding and holding the staples in the drive track. In certain devices, sticks of staples are loaded onto a magazine that is angled downward so that the force of gravity aids in pulling the staples down to the nose of the device and into the drive track to be driven therefrom. However, in certain applications, the fastening device may need to be horizontally disposed or disposed at an upward inclination, thus, the force of gravity alone is insufficient to feed and hold the staples in the drive track.

To increase the force on the staples at the nose of the device, a mechanism having a friction clutch and a wheel connected to an electric motor has been used. Thus, as the motor turns, the clutch maintains a certain torque on the wheel which in turn keeps a constant forward force on the staples. When a staple is driven, the remaining staples are fed and held forward toward the drive track. Although this type of feed mechanism works well for its intended purpose, it requires an extra power source to be connected to the device, and is inefficient and expensive.

Other conventional feed mechanisms employ a spring biased pusher which contacts the rearmost staple of the staple stick urging the staples forward along a guide to the drive track. The device is effective in feeding and holding the staples in the drive track, however, when a staple stick has been exhausted, the pusher must be retracted to allow another staple stick to be placed on the guide. In a continuous production line, such interruptions can be disruptive and costly due to lost productivity.

SUMMARY OF THE INVENTION

An object of the present invention is to provide a fastener feeding and holding assembly for a fastener driving device to feed and hold fasteners in the drive track at any attitude and which permits a supply of fasteners to be fed to the drive track continuously, limited only by the quantity of fasteners provided.

Thus, in accordance with the principles of the present invention, the above object is achieved by providing in a fastener driving apparatus including a nose piece assembly defining an elongated drive track receiving a fastener driving element therein movable through an operating cycle including a drive stroke and return stroke, a fastener feeding assembly for supporting a fastener package within the fastener driving apparatus and for moving successive leading fasteners of the fastener package in a feeding direction into the drive track to be driven by the fastener driving element during the drive stroke thereof outwardly of the drive track into the workpiece. The fastener feeding assembly includes a pair of spaced support members disposed in an opposed relation to one another along a feed path for the fastener package, the feed path having a proximal end leading laterally into the drive track. The feeding assembly also includes a multiplicity of resilient bristles supported at one of the ends thereof by one of the support members and extending transversely and toward the proximal end within the feed path. One of the support members defines a feed track extending along the feed path for supporting the fastener package in a position therealong for movement thereon so that (1) when a leading fastener is disposed in the drive track the remaining fasteners are supported on the feed path so as to permit the leading fastener to be moved from the remaining fasteners through the drive track and driven by the fastener driving element during the drive stroke thereof outwardly of the drive track into the workpiece and (2) the fastener package is engaged by free ends of the multiplicity of bristles sufficient to maintain the fastener package on the feed track against movement in a direction away from the proximal end. One of the support members is mounted to the apparatus in such a manner as to vibrate in a direction toward and away from the other member in response to a vibratory pulse generated by the apparatus during the operating cycle thereof causing the fasteners of the fastener package to repeatedly resiliently flex the bristles in the feeding direction thereby feeding the fasteners toward the drive track and holding a leading fastener of the fastener package in the drive track to be driven therefrom by the driving element into the workpiece.

It is further object of the present invention to provide a fastener feeding assembly including a feeding mechanism and a biasing assembly for moving fasteners toward feeding mechanism.

Thus, in accordance with a second aspect of the invention, these objectives are obtained by providing in a fastener driving apparatus including a nose piece assembly defining an elongated drive track receiving a fastener driving element therein movable through an operating cycle including a drive stroke and return stroke, a fastener feeding assembly for supporting a fastener package within the fastener driving apparatus and for moving successive leading fasteners of the fastener package in a feeding direction into the drive track to be driven by the fastener driving element during the drive stroke thereof outwardly of the drive track into the workpiece. The fastener feeding assembly includes a feeding mechanism mounted to the apparatus so as to be operatively associated with the fastener package, the feeding mechanism (1) feeding the fasteners toward the drive track in such a manner that a continuous supply of fasteners may be fed along a feed path into the drive track, the feed path having a proximal end leading laterally into the drive track and (2) holding a leading fastener of the fastener package in the drive track to be driven therefrom by the driving element. The feeding assembly further includes a biasing assembly for biasing the fasteners toward the feeding mechanism. The biasing assembly includes a pair of spaced support members disposed in an opposed relation to one another along the feed path and a multiplicity of resilient bristles supported at one of the ends thereof by one of the support members and extending transversely and toward the proximal end within said feed path. One of the support members defines a feed track extending along the feed path for supporting the fastener package in a position therealong for movement thereon so that the fastener package is engaged by free ends of the multiplicity of bristles sufficient to maintain the fastener package on the feed track against movement in a direction away from the feeding mechanism. One of the support members is mounted to the apparatus in such a manner as to vibrate in a direction toward and away from the other member in response to a vibratory pulse generated by the apparatus during the operating cycle thereof, causing the fasteners of the fastener package to repeatedly resiliently flex the bristles in the feeding direction thereby feeding the fasteners toward the feeding mechanism and holding the fasteners against movement in a direction away from the feeding mechanism.

Another object of the present invention is the provision of a device of the type described, which is simple in construction, effective in operation and economical to manufacture and maintain.

These and other objects of the present invention will become apparent during the course of the following detailed description and appended claims.

The invention may be best understood with reference to the accompanying drawings wherein an illustrative embodiment is shown.

DETAILED DESCRIPTION OF THE PRESENTLY PREFERRED EXEMPLARY EMBODIMENTS

Figure 1:
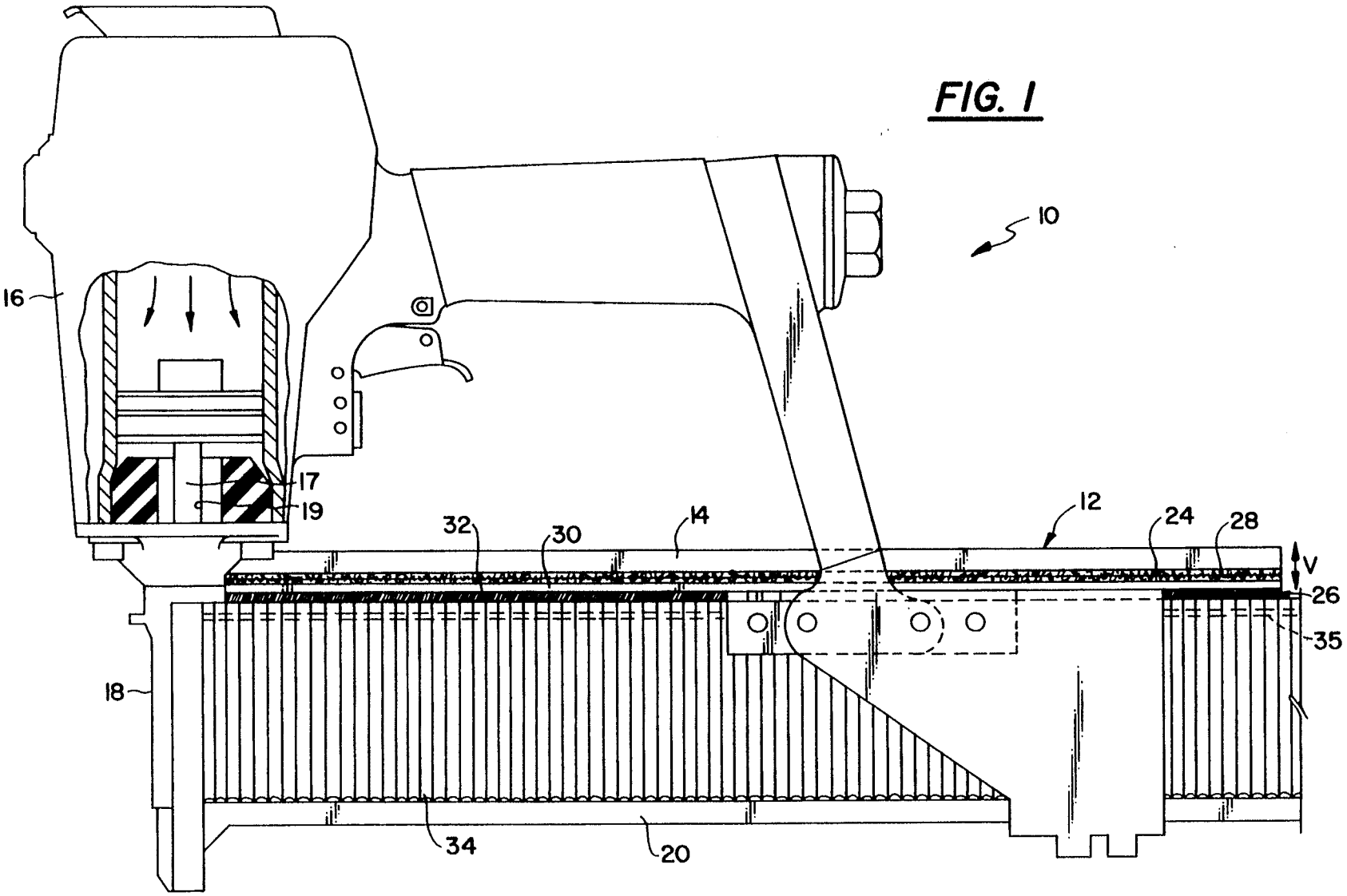
FIG. 1 is a side elevation view with parts in section, of a pneumatically operated fastener driving device including a fastener feeding assembly provided in accordance with the principles of the present invention.

Referring now more particularly to FIGS. 1 of the drawings, a fastener driving device, generally indicated at 10 is shown having a fastener feeding assembly, generally indicated at 12, embodying the principles of the present invention. The device 10 includes the usual fastener driving element 17 which is moved through an operating cycle including a drive stroke and a return stroke preferably by a conventional pneumatic system (not shown). Although it is preferable to use a pneumatically powered system to actuate the driving element 17, it is within the contemplation of the invention to employ manual actuation of the driving element.

The device 10 includes a rigid housing 16 including a nose piece 18 having internal surfaces defining an elongated drive track 19. A staple magazine assembly 20 is secured to the nose piece 18 and extends rearwardly therefrom. The magazine assembly 20 may be of any conventional design, adapted to receive a supply of staples in the form of a staple stick and guide the staples forwardly, along a feed path, having a proximal end leading laterally into the drive track 19, into the drive track 19 to be driven outwardly thereof by the fastener driving element 17.

It will be understood that the device 10 and magazine assembly 20 are illustrative only and that they may be of any known equivalent constructions.

In the illustrated embodiment, the feeding assembly 12 includes a vibratory plate 14 mounted above the magazine assembly 20 and extending in the longitudinal direction thereof from the distal end of the magazine assembly to the nose piece 18. In the illustrated embodiment, the vibratory plate 14 is preferably a thin, flexible, metal plate. As shown in FIG. 1, a hook and loop or VELCRO strip 24 is adhered to the underside of the vibratory plate 14.

Figure 2:
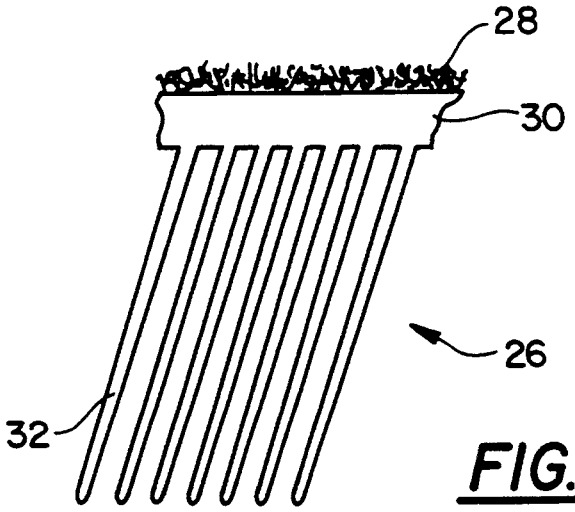
FIG. 2 is an enlarged partial side view of resilient bristles of the feeding assembly of FIG. 1, provided in accordance with the principles of the present invention.
Figure 3:
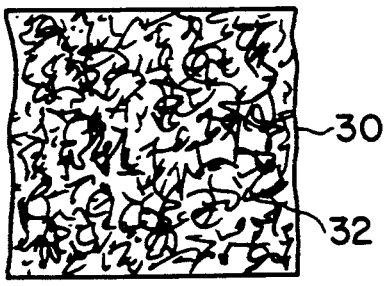
FIG. 3 is and enlarged partial plan view of the resilient bristles of FIG. 2.

The feeding assembly 12 further includes a brush member, generally indicated at 26 including a hook and loop or VELCRO strip 28 which mates with strip 24 so that the brush member 26 is removably coupled to the vibratory plate 14. Thus, if the brush member becomes worn or dirty, it may simply be replaced. The brush member 26 comprises a base 30 having a plurality of closely spaced, individual resilient bristles 32 extending therefrom (FIG. 2). The bristles 32 are resilient enough to bend in the feed direction upon contact with the fasteners 34. As shown in FIGS. 1 and 2, the bristles 32 are inclined from a perpendicular to the base 30 so that the free ends thereof are disposed in a direction toward the nose piece 18. The orientation of the bristles 32 ensures that the contacted fasteners 34 are biased toward the nose piece 18 by ensuring that resilient flexing of the bristles 32 upon contact with the fasteners is always in a direction of feed and not in a reverse direction, as will become more apparent below. The bristles 32 are preferably made of polypropylene and are of the type described in U.S. Pat. No. 4,068,029, the disclosure of which is hereby incorporated hereinto by this reference. As shown in FIG. 1, the bristles 32 extend the length of vibratory plate 14 and contact a top portion of the fasteners 34 of the staple stick. The bristles are stiff, yet resilient, permitting a supply of fasteners to be continuously supplied to the magazine assembly from the distal end thereof.

The feeding assembly also includes a support member defining a feed track 35 disposed in a spaced, opposed relation with respect to the vibratory plate and extending along the feed path. The feed track 35 supports the fastener package in a position along the feed path for movement thereon so that when a leading fastener is disposed in the drive track the remaining fasteners are supported on the feed path so as to permit the leading fastener to be moved from the remaining fasteners through the drive track and driven by the fastener driving element during the drive stroke thereof outwardly of the drive track into the workpiece.

The operation of the biasing assembly 12 will be appreciated with reference to FIG. 1. As the engine (not shown) of the device 10 cycles, a vibratory pulse is created from each operating cycle. The vibratory plate 14 is coupled to the device 10 so that the initial vibratory pulse generated by each successive cycle is continued over time due to resonating of the vibratory plate 14. The shape and thickness of the vibratory plate 14 is determined so that the plate 14 vibrates in the vertical direction as indicated by arrow V in FIG. 1. The brush member 26 vibrates simultaneously with the vibratory plate 14 since it is coupled thereto. The vibratory pulsing causes the bristles 32 to contact the fasteners which are supported on the feed track 35. Upon contact with the fasteners, the inclined bristles 32 are compressed and repeatedly resiliently flexed in the direction of feed (toward the nose piece), thus causing the fasteners to move along the feed track 35 toward the drive track 19 of the device 10. The forwardly inclined bristles 32 act as a check pawl and do not easily allow the fasteners to reverse direction. Thus, a leading staple of the staple stick is held in the drive track by the biasing assembly 12 to be driven therefrom by the driving element during the drive stroke of the device 10.

It is preferable to cause the initial vibratory pulse of the device 10 to continue over time so that the fasteners travel a maximum distance per each vibratory pulse. Thus, plate 14 is made flexible so that the initial vibratory pulse is continued over time at a reduced amplitude due to resonating of plate 14.

It is within the contemplation of the invention that as an alternative to providing the vibratory plate 14 of flexible material, the plate may be rigid. When the plate 14 is rigid and the brush member 26 is coupled thereto, it is preferable that the feed track 35 be capable of resonating due to the initial pulse vibration of the device. Thus, in this situation, the initial vibratory pulse of the device 10 causes the feed track 35 to resonate, thus permitting the fasteners to repeatedly contact and bend the bristles 32 of the brush member 26 which in turn causes the fasteners to move toward the drive track 19 of the device 10, as described above.

It can be appreciated that the brush member 26 may be disposed in a position other that shown in FIG. 1. For example, the brush member may be mounted on the feed track 35 so that the fasteners rest directly on the bristles 32. A rigid plate may be provided above the fasteners so that the initial pulse vibration of the device causes the feed track and/or the plate to resonate so that the fasteners engage the plate causing the bristles to repeatedly flex, as described above, moving the fasteners toward the drive track.

It is within the contemplation of the present invention to mount the brush member so as to contact a side portion of the fastener package. In this situation, the initial pulse vibration must be continued in the direction of the feed track, as opposed to the vertical direction as discussed above. Thus, the brush member may be mounted on a support structure and a second support structure may be mounted in an opposed relation to the brush member with the fastener package disposed between the support structures. The pulse vibration will cause at least one of the support structures to resonate toward and away from the other support structure so that the bristles are repeatedly resiliently flexed in the feed direction causing the fasteners to move towards the drive track.

Thus, it can be appreciated that the feeding assembly 12 is actuated by the vibration energy inherent in the operation of the device 10. No extra power source is required to feed and hold the fasteners in position to be driven from the device. Since the feeding assembly 12 is not dependent on the force of gravity, it may be used in attitudes that gravity feed systems cannot be employed. Further, unlike gravity systems which only feed fasteners, the feeding assembly 12 both feeds and holds the fasteners. In addition, unlike pusher members which must be retracted to place another staple stick in the device, the feeding assembly permits continuous feeding of fasteners.

It is within the contemplation of the present invention to utilize the feeding assembly as described above in conjunction with other feeding mechanisms which permit continuous feeding of fasteners.

Figure 4:
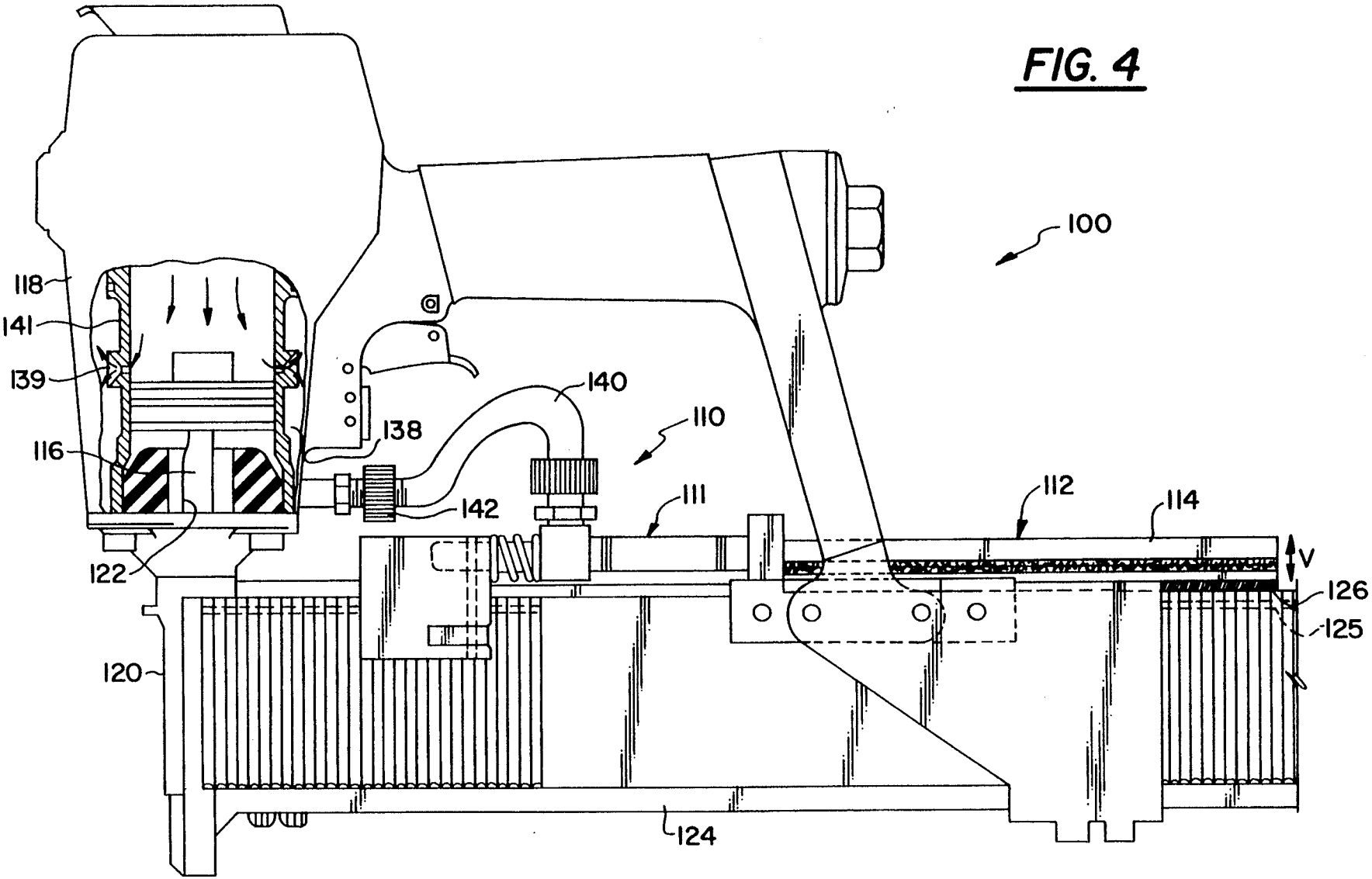
FIG. 4 is a side elevation view, with parts in section, of a pneumatically operated fastener driving device including a feeding assembly, provided in accordance with the principles of a second embodiment of the present invention.
Figure 5:
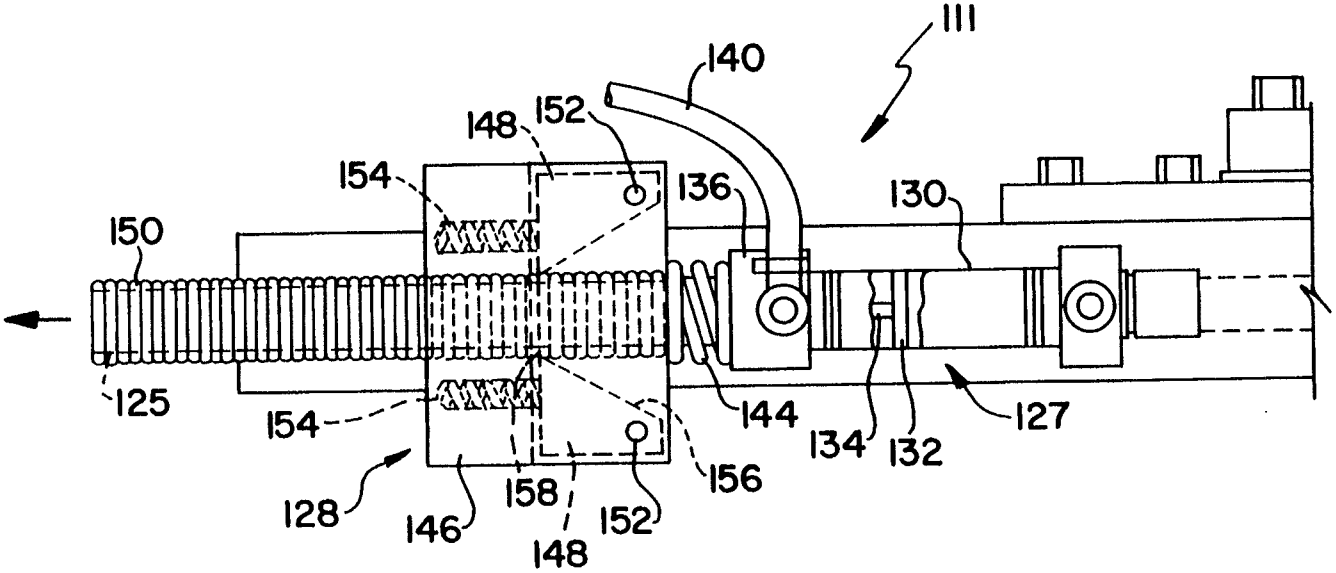
FIG. 5 is a plan view of the feeding mechanism of the feeding assembly of FIG. 4, provided in accordance with the principles of the present invention.

Referring now more particularly to FIGS. 4 and 5 of the drawings, a fastener driving device, generally indicated at 100 is shown having a fastener feeding assembly 110 including a feeding mechanism, generally indicated at 111 and a fastener biasing assembly, generally indicated at 112, embodying the principles of a second embodiment of the present invention. As in the first embodiment, the device 100 includes the usual fastener driving element 116 which is moved through an operating cycle including a drive stroke and a return stroke preferably by a conventional pneumatic system (not shown).

The device 100 includes a rigid housing 118 including a nose piece 120 having internal surfaces defining an elongated drive track 122. A staple magazine assembly 124 is secured to the nose piece 120 and extends rearwardly therefrom. The magazine assembly 124 may be of any conventional design, adapted to receive a supply of staples in the form of a staple stick and guide the staples forwardly on a feed track 125 into the drive track to be driven outwardly thereof by the staple driving element.

The feeding mechanism 111 includes an actuating mechanism generally indicated at 127 and a fastener holding mechanism, generally indicated at 128. As best shown in FIG. 5, the actuating mechanism includes a cylinder 130 coupled to the device 100 at one end thereof. A piston 132 is slidably mounted within the cylinder and has a piston actuating rod 134 formed thereon extending outwardly of the cylinder. The outer end of the actuating rod 134 is coupled to the holding mechanism. The piston-cylinder arrangement may be of any conventional design, for example, Model No. O1DX manufactured by BIMBA. The actuating mechanism also includes an air inlet portion 136 which communicates with the plenum chamber 138 of the device 100 via tube 140 and connector 142, the function of which will become apparent below. The actuating mechanism 127 further includes a spring 144 coupled to the holding mechanism 128 at one end thereof, with the other end contacting a surface of the inlet portion 136. The spring 144 normally biases the holding mechanism in a direction toward the drive track.

As shown in FIG. 5, the fastener holding mechanism 128 includes a feed block 146 supporting a pair of holding pawls 148 disposed on opposing sides of the staple stick 150. Each holding pawl 148 is pivotally coupled to the feed block 146 by a pin 152 at one end thereof. A compression spring 154 is coupled to an opposite end of each holding pawl 148 at a position offset from an axis of the pin 152. The other end of the compression spring 154 is coupled to the feed block 146. Each holding pawl 148 includes an angled surface 156 terminating at engaging edge 158. Edge 158 contacts a point between staples of the exposed portion of the staple stick due to the bias of spring 144.

The fastener biasing assembly 112 is identical to the fastener feeding assembly 12 of FIG. 1, except that the plate 114 thereof extends only to feeding mechanism 112. As shown in FIG. 4, the vibratory plate 114 is disposed rearward of the actuating mechanism 127 and extends to the distal end of the magazine assembly 124. The brush member 126 supported on plate 114 contacts the top portions of the rearmost fasteners in the magazine assembly 124. As in the first embodiment, the bristles are inclined so that free ends thereof are disposed in a direction toward the drive track 122 to bias the fasteners toward the drive track. The feed track 125 extends to the nose piece and is disposed in a space, opposed relation with respect to the vibratory plate 114.

The operation of the feeding assembly 110 will be appreciated with reference to FIGS. 4 and 5. Spring 144 normally biases the holding mechanism 128 in a position toward the drive track during an operating stroke of the actuating mechanism 127. The forward motion of the holding mechanism 128 causes the holding pawls 148 to be rotated to contact the exposed portion of the staple stick due to a moment created by the compression springs 154 being offset from the pins 152. Thus, during an initial part of the drive stroke, the spring 144 ensures that a leading staple of the staple stick is disposed in the drive track. The driving element 116 moves downward within the drive track and contacts the leading staple. When the driving element has sheared off the leading staple and is part-way through its drive stroke, the driving element passes plenum feed holes 139 in cylinder sleeve 141. Pressurized air then flows into plenum chamber 138 which is fed through tube 140 and into the pneumatic cylinder 130. The pressurized air moves the piston 132 in a direction away from the drive track compressing the spring 144, thus permitting the holding mechanism 128 to move away from the drive track during a return stroke of the actuating mechanism. When the holding mechanism is pulled-back by the pneumatic cylinder 132, the holding pawls 148 are rotated away from the staple stick by the force of inertia of the remaining staples acting on angled surface 156 of the holding pawls 148.

The angle of surface 156 and the spring force of springs 154 are such that the holding pawls rotate off the staples and do not pull the staples back toward the cylinder 132. Thus, the holding pawls release the staples during the return stroke of the actuating mechanism, during a portion of the operating cycle of the device 100 when it is not critical to hold the staples securely in the nose.

After the return stroke of the driving element 116 is complete, the plenum air is exhausted through the nose piece 120 and removed from the cylinder 132 which causes spring 144 to expand and again push the holding mechanism 128 toward the drive track.

It can be appreciated that during the operating cycle of the device 100, vibration caused by the engine (not shown) vibrates the vibratory plate 114 of the biasing assembly 112. As in the first embodiment, the brush member 126 contacts the fasteners and the inclined bristles are compressed and repeatedly resiliently flex in the direction of feed (toward the nose piece), thus causing the fasteners to move toward the feeding mechanism 111. Thus, the biasing assembly 112 aids in feeding and holding the fasteners in a direction toward the drive track at attitudes which gravity alone cannot.

It is within the contemplation of the present invention to utilize the biasing assembly 112 with other feeding devices which permit continuous feeding of fasteners.

From the foregoing, it can be appreciated that the fastener feeding assembly 110 offers numerous advantages over prior art feeding devices. Since feeding and holding of the staples is not performed from behind the staple stick, feeding is only limited by the length of the staple stick provided and need not be interrupted to retract a pusher.

Further, no extra power source needs to be connected to the device. The feeding mechanism 111 is signaled by the device's plenum air and is automatically timed to the operating cycle. In addition, since the plenum air is used against a spring, the feeding mechanism is efficient.

It thus will be appreciated that the objects of the invention have been fully and effectively accomplished. It will be realized, however, that the foregoing preferred embodiment of the present invention has been shown and described for the purpose of illustrating the structural and functional principles of the present invention and is subject to change without departure from such principles. For example, although the present invention was described with reference to staple fasteners, it is contemplated that the feeding mechanism and/or biasing assembly of the present invention may be employed for feeding and holding other fasteners, such as nails. Thus, the invention includes all the modifications encompassed within the spirit of the following claims.

What is claimed is:

1. In a fastener driving apparatus including a nose piece assembly defining an elongated drive track receiving a fastener driving element therein movable through an operating cycle including a drive stroke and return stroke, a fastener feeding assembly for supporting a fastener package within the fastener driving apparatus and for moving successive leading fasteners of the fastener package in a feeding direction into the drive track to be driven by the fastener driving element during the drive stroke thereof outwardly of the drive track into the workpiece, the fastener feeding assembly comprising:

a pair of spaced support structures disposed in an opposed relation to one another along a feed path for the fastener package, the feed path having a proximal end leading laterally into the drive track; and a multiplicity of resilient bristles supported at one of the ends thereof by one of said support structures and extending transversely and toward said proximal end within said feed path, one of said support structures defining a feed track extending along said feed path for supporting the fastener package in a position therealong for movement thereon so that (1) when a leading fastener is disposed in the drive track the remaining fasteners are supported on the feed path so as to permit the leading fastener to be moved from the remaining fasteners through the drive track and driven by the fastener driving element during the drive stroke thereof outwardly of the drive track into the workpiece and (2) the fastener package is engaged by free ends of said multiplicity of bristles sufficient to maintain the fastener package on said feed track against movement in a direction away from said proximal end, one of said support structures being mounted to said apparatus in such a manner as to vibrate in a direction toward and away from the other support structure in response to a vibratory pulse generated by the apparatus during the operating cycle thereof causing the fasteners of the fastener package to repeatedly resiliently flex the bristles in the feeding direction thereby feeding the fasteners toward the drive track and holding a leading fastener of the fastener package in the drive track to be driven therefrom by the driving element into the workpiece.

2. The fastener feeding assembly as claimed in claim 1, wherein one of said support structures is a flexible plate, said flexible plate supporting said multiplicity of bristles, the other of said support structures defining said feed track, said flexible plate mounted to the apparatus so as to resonate due to the vibratory pulse generated by the apparatus.

3. The biasing assembly as claimed in claim 2, wherein the multiplicity of bristles contact top portions of said fasteners.

4. The fastener feeding assembly as claimed in claim 1, wherein said multiplicity of bristles are made of polypropylene.

5. The fastener feeding assembly as claimed in claim 1, wherein said multiplicity of bristles are disposed on a brush member, said brush member being removably coupled to one of said support structures.

6. The fastener feeding assembly as claimed in claim 5, wherein said brush member is coupled to said support structures by mating hook and loop fastening.

7. The fastener feeding assembly as claimed in claim 1, wherein said multiplicity of bristles contact top portions of said fasteners.

8. The fastener feeding assembly as claimed in claim 1, wherein said fastener package is in the form of a stick.

9. The fastener feeding assembly as defined in claim 1, wherein said fasteners are staples.

10. In a fastener driving apparatus including a nose piece assembly defining an elongated drive track receiving a fastener driving element therein movable through an operating cycle including a drive stroke and return stroke, a fastener feeding assembly for supporting a fastener package within the fastener driving apparatus and for moving successive leading fasteners of the fastener package in a feeding direction along a feed path into the drive track to be driven by the fastener driving element during the drive stroke thereof outwardly of the drive track into the workpiece, the fastener feeding assembly comprising:

a multiplicity of resilient bristles supported at one of the ends thereof and extending transversely and toward said drive track along said feed path, means for supporting said bristles; and means for supporting said fastener package disposed in an opposed relation to said bristle supporting means along said feed path, one of said supporting means being mounted to said apparatus in such a manner as to vibrate in a direction toward and away from the other supporting means in response to a vibratory pulse generated by the apparatus during the operating cycle thereof causing the fasteners of the fastener package to repeatedly resiliently flex the bristles in the feeding direction thereby feeding the fasteners toward the drive track and holding a leading fastener of the fastener package in the drive track to be driven therefrom by the driving element into the workpiece.

11. The feeding assembly as defined in claim 10, wherein one of said supporting means defines a feed track extending along said feed path for supporting the fastener package in a position therealong for movement thereon so that (1) when a leading fastener is disposed in the drive track the remaining fasteners are supported on the feed path so as to permit the leading fastener to be moved from the remaining fasteners through the drive track and driven by the fastener driving element during the drive stroke thereof outwardly of the drive track into the workpiece and (2) the fastener package is engaged by free ends of said multiplicity of bristles sufficient to maintain the fastener package on said feed track against movement in a direction away from said drive track.

12. In a fastener driving apparatus including a nose piece assembly defining an elongated drive track receiving a fastener driving element therein movable through an operating cycle including a drive stroke and return stroke, a fastener feeding assembly for supporting a fastener package within the fastener driving apparatus and for moving successive leading fasteners of the fastener package in a feeding direction into the drive track to be driven by the fastener driving element during the drive stroke thereof outwardly of the drive track into the workpiece, the fastener feeding assembly comprising:

a feeding mechanism mounted to the apparatus so as to be operatively associated with the fastener package, the feeding mechanism (1) feeding the fasteners toward the drive track in such a manner that a continuous supply of fasteners may be fed along a feed path into the drive track, the feed path having a proximal end leading laterally into the drive track and (2) holding a leading fastener of the fastener package in the drive track to be driven therefrom by the driving element; and a biasing assembly for biasing the fasteners toward the feeding mechanism, the biasing assembly comprising:

a pair of spaced support members disposed in an opposed relation to one another along the feed path; and a multiplicity of resilient bristles supported at one of the ends thereof by one of said support members and extending transversely and toward said proximal end within said feed path, one of said support members defining a feed track extending along said feed path for supporting the fastener package in a position therealong for movement thereon so that the fastener package is engaged by free ends of said multiplicity of bristles sufficient to maintain the fastener package on said feed track against movement in a direction away from said feeding mechanism, one of said support members being mounted to said apparatus in such a manner as to vibrate in a direction toward and away from the other member in response to a vibratory pulse generated by the apparatus during the operating cycle thereof causing the fasteners of the fastener package to repeatedly resiliently flex the bristles in the feeding direction thereby feeding the fasteners toward the feeding mechanism and holding the fasteners against movement in a direction away from said feeding mechanism.

13. The assembly as claimed in claim 12, wherein the feeding mechanism comprises:

an actuating mechanism mounted for movement through an operating cycle including (1) an operative stroke in the feeding direction toward the drive track for feeding fasteners to the drive track and (2) a return stroke; and a fastener holding mechanism operatively coupled to said actuating mechanism for movement therewith through the operating cycle thereof, whereby during the operative stroke of the actuating mechanism the fastener holding mechanism holds the fasteners in position biased toward the drive track during at least a portion of the drive stroke so that the leading fastener from the fastener package is disposed in the drive track in position to be contacted by the driving element, the fastener holding mechanism being released from the fasteners during the return stroke of the actuating mechanism during a portion of operating cycle of the driving element when a fastener need not be held in the drive track.

14. The assembly as defined in claim 13, wherein said actuating mechanism includes a spring member which biases the holding mechanism and thus the fasteners toward the drive track during the operative stroke and a piston including an actuating rod coupled to the holding mechanism, the piston being slidingly received in a cylinder and pneumatically connected to a plenum chamber of the fastener driving apparatus so as to be supplied with plenum air after the drive element moves downward within the drive track and contacts the leading fastener, the plenum air moving the piston so as to overcome the bias of the spring permitting the actuating rod to cause the holding mechanism to release from the fasteners, the plenum air supplied to the piston exhausting after completion of the return stroke of the driving element permitting the spring to bias the holding mechanism and thus the fasteners again toward the drive track so that another fastener may be disposed within the drive track to be contacted by the driving element.

15. A assembly as defined in claim 13, wherein said holding mechanism includes a feed block operatively coupled to said actuating mechanism, said feed block supporting a pair of feed pawls disposed on opposing sides of the fastener package, each feed pawl of the pair of feed pawls contacting the fastener package during the operative stroke of the actuating mechanism.

16. The assembly as defined in claim 15, wherein said feed pawls have first and second ends, said first ends being pivotally coupled to said feed block by pins, each of said second ends being coupled to a compression spring disposed axially offset from said pins, whereby during the operative stroke of the actuating mechanism, said compression springs bias the pawls to hold the fasteners in position toward the drive track, said feed pawls pivoting away from the fasteners during the return stroke of the actuating mechanism.

17. The assembly as claimed in claim 12, wherein one of said support members is a flexible plate, said flexible plate supporting said multiplicity of bristles, the other of said support members defining said feed track, said flexible plate mounted to the apparatus so as to resonate due to the vibratory pulse generated by the apparatus.

18. The assembly as claimed in claim 17, wherein the multiplicity of bristles contact top portions of said fasteners.

19. The assembly as claimed in claim 12, wherein said multiplicity of bristles are made of polypropylene.

20. The assembly as claimed in claim 12, wherein said multiplicity of bristles are disposed on a brush member, said brush member being removably coupled to one of said support members.

21. The assembly as claimed in claim 20, wherein said brush member is coupled to said support member by mating hook and loop fastening.

22. The assembly as claimed in claim 12, wherein said multiplicity of bristles contact top portions of said fasteners.

23. In a fastener driving apparatus including a nose piece assembly defining an elongated drive track receiving a fastener driving element therein movable through an operating cycle including a drive stroke and return stroke, a fastener feeding assembly for supporting a fastener package within the fastener driving apparatus and for moving successive leading fasteners of the fastener package in a feeding direction into the drive track to be driven by the fastener driving element during the drive stroke thereof outwardly of the drive track into the workpiece, the fastener feeding assembly comprising:

a feeding mechanism mounted to the apparatus so as to be operatively associated with the fastener package, the feeding mechanism (1) feeding the fasteners toward the drive track in such a manner that a continuous supply of fasteners may be fed along a feed path into the drive track, the feed path having a proximal end leading laterally into the drive track and (2) holding a leading fastener of the fastener package in the drive track to be driven therefrom by the driving element; and a biasing assembly for biasing the fasteners toward the feeding mechanism, the biasing assembly comprising:

a multiplicity of resilient bristles supported at one of the ends thereof and extending transversely and toward said drive track along said feed path, means for supporting said bristles; and means for supporting said fastener package disposed in an opposed relation to said bristle supporting means along said feed path, one of said supporting means being mounted to said apparatus in such a manner as to vibrate in a direction toward and away from the other supporting means in response to a vibratory pulse generated by the apparatus during the operating cycle thereof causing the fasteners of the fastener package to repeatedly resiliently flex the bristles in the feeding direction thereby feeding the fasteners toward the drive track and holding a leading fastener of the fastener package in the drive track to be driven therefrom by the driving element into the workpiece.

* * * * *